US005369845A

United States Patent [19]

Locatelli

[11] Patent Number: 5,369,845

[45] Date of Patent: Dec. 6, 1994

[54] DEVICE FOR FIXING RECTILINEAR COMBS IN A COMBING MACHINE

[75] Inventor: Claudio Locatelli, Capriolo, Italy

[73] Assignee: Industrie Meccanotessili Marzoli S.r.l., Bergamo, Italy

[21] Appl. No.: 10,255

[22] Filed: Jan. 28, 1993

[30] Foreign Application Priority Data

Jan. 29, 1992 [IT] Italy ..... MI92U000069

[51] Int. Cl.[5] ..... D01G 19/00

[52] U.S. Cl. ..... 19/115 R

[58] Field of Search ..... 19/220, 221, 228, 223, 19/224, 112, 113, 114, 115 R, 129, 219, 225, 226, 227, 229, 232, 125, 129 R

[56] References Cited

U.S. PATENT DOCUMENTS

| | | | |
|---|---|---|---|
| 1,260,876 | 3/1918 | Crockett | 19/224 |
| 2,052,531 | 8/1936 | Howard | 19/224 |
| 2,572,122 | 10/1951 | Dudley et al. | 19/224 |
| 3,601,861 | 8/1971 | Moriwaki . | |
| 4,190,408 | 2/1980 | Bronkema et al. | 425/123 |

FOREIGN PATENT DOCUMENTS

| | | | |
|---|---|---|---|
| 2097701 | 2/1972 | France . | |
| 1120330 | 12/1961 | Germany . | |
| 843670 | 11/1958 | United Kingdom | 19/220 |

*Primary Examiner*—Clifford D. Crowder
*Assistant Examiner*—Larry D. Worrell, Jr.
*Attorney, Agent, or Firm*—Diller, Ramik & Wight

[57] ABSTRACT

To fix the rectilinear combs (4) of a combing machine, a pneumatic system is provided comprising presser elements (16) acting on the section bars (5) of the combs (4) and operated by respective pistons (17) which move within chambers (18) provided in the supports (7) for the section bars (5) and connectable selectively to a compressed air source (22) or to discharge (28). During locking, the presser elements (16) press the section bars (5) of the combs (4) against the supports (7) via plates (20) removably fixed to the ends of the rods (19) of the pistons (17). Discharging the compressed air from the chambers (18) results in simultaneous release of the combs (4). The traditional operations of clamping and releasing the individual comb units (4) are hence eliminated, and the time required for cleaning or replacing the combs is considerably shortened.

11 Claims, 2 Drawing Sheets

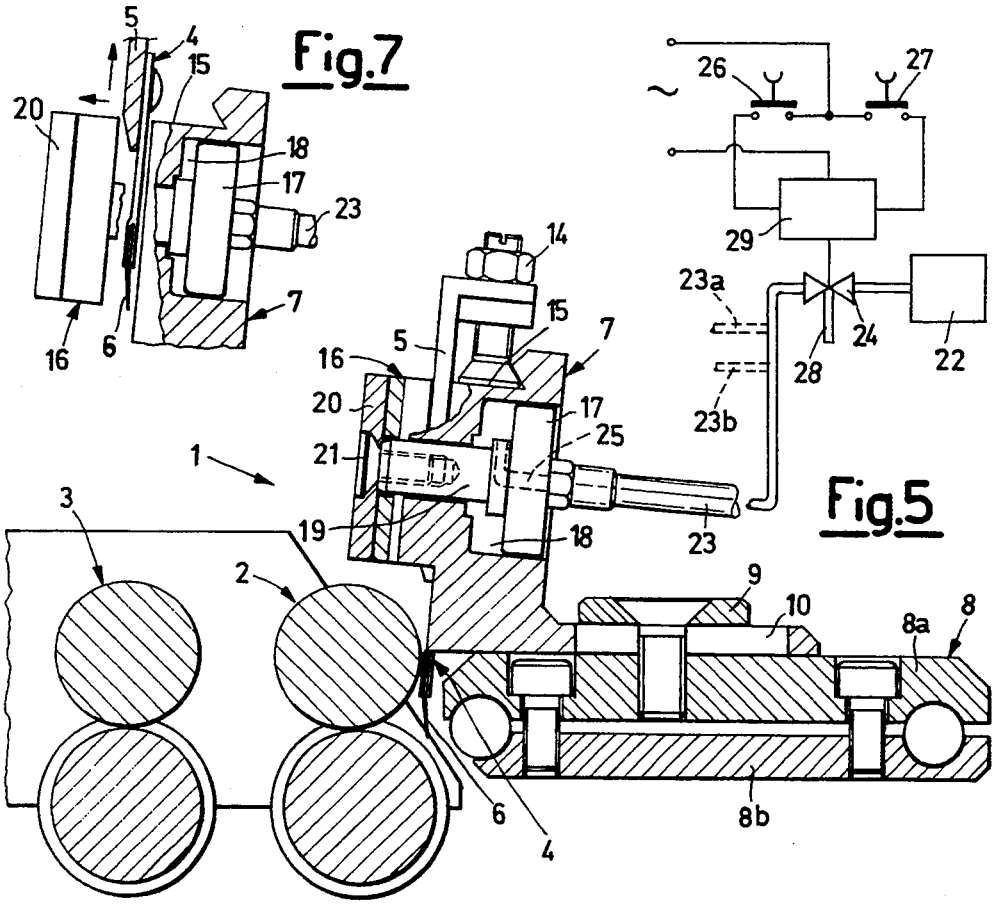
Fig.7
Fig.5
1
2
3
4
5
6
7
8
8a
8b
9
10
14
15
16
17
18
19
20
21
22
23
23a
23b
24
25
26
27
28
29
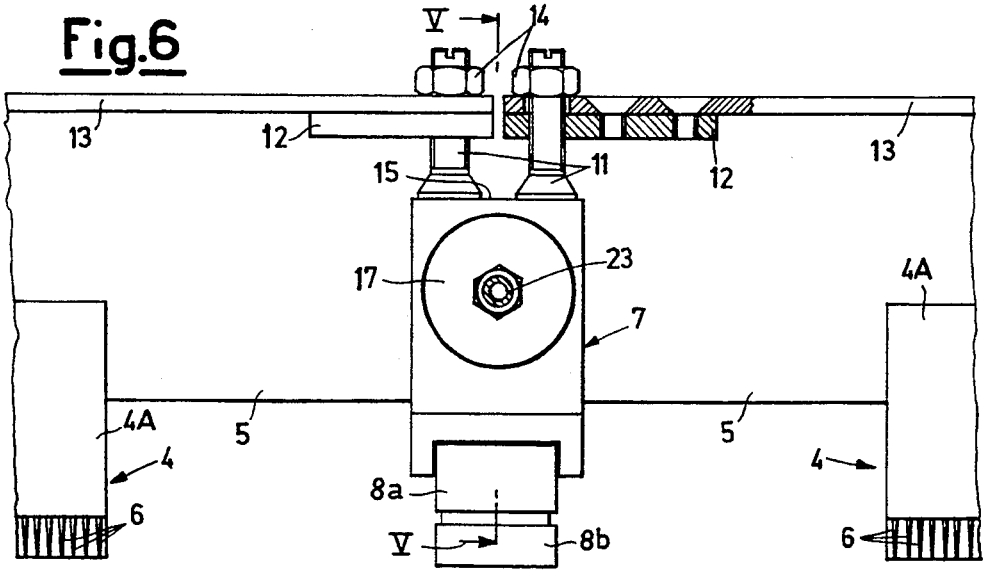
Fig.6
V
4
4A
5
6
7
8a
8b
11
12
13
14
15
17
23

DEVICE FOR FIXING RECTILINEAR COMBS IN A COMBING MACHINE

BACKGROUND OF THE INVENTION

This invention relates to a device for fixing rectilinear combs in a combing machine.

As is well known, in these machines the purpose of the rectilinear combs is to penetrate into the cloth at that moment in which the tufts are drawn by the drawing rollers during combing, in order to separate those tufts which have just been combed from the following tufts still to be combed. The rectilinear combs consist of a series of adjacent needles fixed to substantially laminar elongate comb segments, which themselves are fixed to respective section bars resting on and locked onto supports rigid with the frame of the gripper unit.

The comb segments fixed to the section bars can be adjusted linearly by screws which screw into a projecting appendix of the section bars so that their ends rest against said supports to define and adjust the position of the combs in terms of height. The section bars are locked individually on said supports by levers or lever hooks at the ends of the section bars.

The combs are easily soiled, as dust residues or other materials or fibres deposit between the needles during combing. The combs must therefore be regularly and frequently cleaned, this being done by releasing the fixing levers of the individual combs and removing the combs for cleaning. The cleaned combs are then remounted and individually locked by the fixing levers. The same operations have to be carried out whenever one or more combs are to be replaced.

These operations, which may appear simple and rapid, result in practice in a considerable time wastage because of the frequency with which cleaning is required.

SUMMARY OF THE INVENTION

An object of the present invention is to provide a fixing device for the rectilinear combs in a combing machine which allows the combs to be removed and remounted extremely rapidly for their cleaning or replacement, while maintaining their proper setting, and which is constructionally of low cost.

A further object of the invention is to provide a fixing device which does not require modification to the rectilinear combs or parts of them, and which can also be applied to currently used combing machines without substantial modification to them.

These and further objects which will be more apparent hereinafter are attained by a fixing device for rectilinear combs in a combing machine, comprising supports to which section bars for supporting the combs can be removably fixed by fixing means, characterised in that said fixing means comprise pneumatically operated presser elements.

With a device of this type the time required for maintaining and/or replacing the rectilinear combs of the machine is substantially reduced as it is no longer necessary to manually close and release the fixing levers of the individual combs, but instead the section bars for the combs are released or locked pneumatically and hence extremely rapidly in addition to automatically. The operator is merely required to take away the section bars with their combs and to return them into position.

To release and lock the comb section bars it is sufficient for example to operate a pushbutton which acts on the pneumatic system. Advantageously the release and locking can take place simultaneously for all the combs of the machine.

The pneumatic system for simultaneously releasing and locking the combs can also be controlled by opening and respectively closing the cowling which covers the gripper units.

Advantageously the pneumatic fixing system can be associated with and/or integrated into the support for the comb section bars, so maintaining small dimensions and enabling the device to be applied to traditional combing machines by merely modifying the supports.

BRIEF DESCRIPTION OF THE DRAWINGS

Further details and advantages of the invention will be more apparent from the following description of a preferred embodiment thereof, illustrated on the accompanying drawings, in which:

FIG. 5 is a section through the fixing device on the line V—V of FIG. 6;

FIG. 6 is a rear view of the device taken at two adjacent combs;

FIG. 7 shows in partial section a detail of the device during the release of the comb.

DESCRIPTION OF THE PREFERRED EMBODIMENTS

Figure 1:
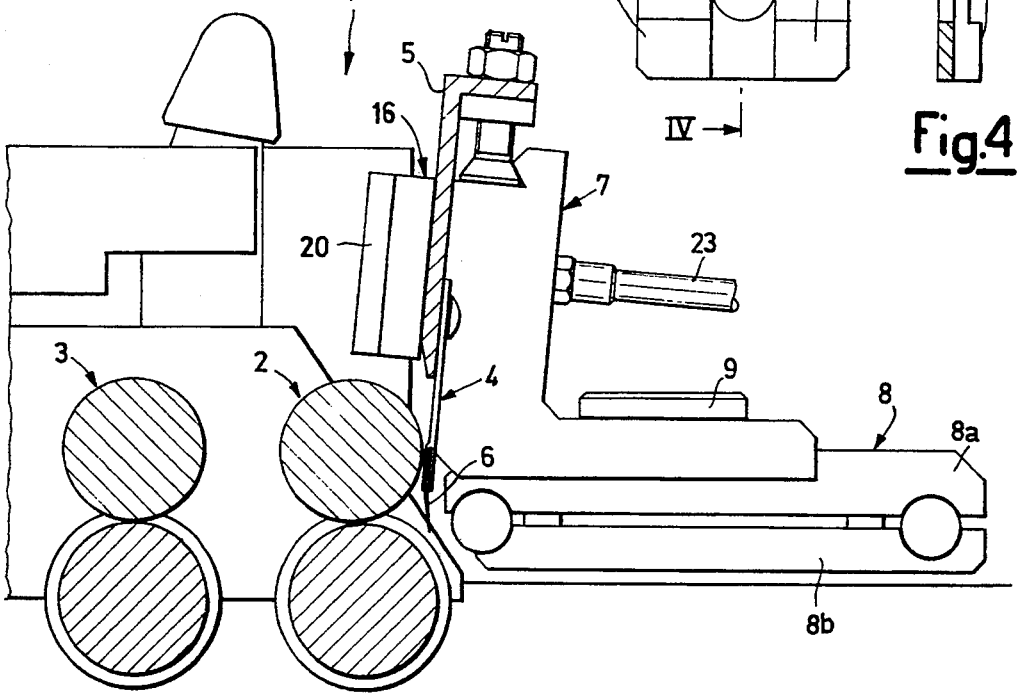
FIG. 1 is a view of the fixing device according to the invention taken in section on the line I—I of FIG. 2.
Figure 3:
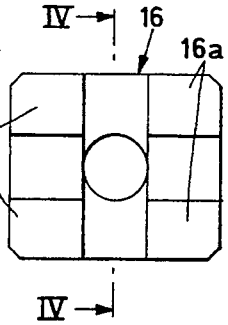
FIG. 3 is a front view of a presser element of the device.
Figure 4:
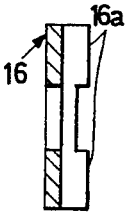
FIG. 4 is a section on the line IV—IV of FIG. 3.
Figure 2:
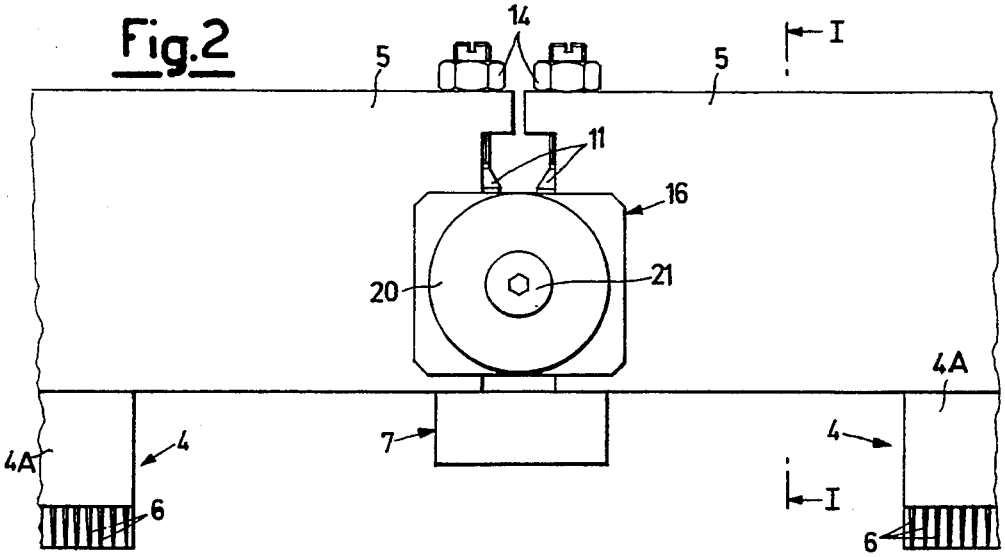
FIG. 2 is a frontal view of the device taken at the fixing of two rectilinear combs.

The figures show that part 1 of a combing machine at the drawing rollers 2 and 3, in proximity to which the rectilinear combs 4 are positioned. The combs 4 are formed in known manner from respective elongate laminar segments 4A lowerly carrying a plurality of needles 6 and fixed to respective supporting section bars 5. Each section bar 5 is removably fixed at its ends to a support 7 together with the section bar 5 of the adjacent comb 4. The angle-shaped supports 7 are fixed to respective blocks 8 which consist of two parts (**8*a* and 8*b*), of known type, and are connected rigidly in conventional manner to the gripper frame, not shown. The supports 7 can be adjusted horizontally on the respective blocks 8 in a direction perpendicular to the axes of the drawing rollers 2 and 3 by a respective screw 9 which passes through a slot 10 in the supports 7 and is screwed into the respective block 8**.

The combs 4 are also height-adjustable relative to the supports 7 in known manner by adjustment screws 11 which screw into plates 12 rigid with the ends of angle appendices 13 on the section bars 5 and lockable by nuts 14 in a position projecting to a greater or lesser extent from the appendices 13, in which position the screws 11 rest against positioning surfaces 15 of the supports 7.

According to the invention, the means for fixing the section bars 5 to the supports 7 comprise pneumatically operated pressers 16. In the illustrated form, each presser element 16 consists of a substantially C-shaped presser block arranged to engage two adjacent section bars 5 by means of the end surfaces **16*a* of the C. The presser block 16 is operated by a pneumatic piston 17, moving between a position in which the block 16 clamps the section bars 5 against the support 7 (FIGS. 1** and 5) and a position in which the block 16 releases the section bars 5 (FIG. 7), to enable these latter and hence the combs 4 to be removed.

Advantageously, the piston 17 moves within a chamber 18 formed directly within the support 7. The piston acts as a closure wall for the chamber 18 in the outward direction from the support 7. In this manner a particularly contained structure is obtained, even though having a relatively large surface and hence able to provide an effective fixing action for the section bars 5 and hence for the combs 4.

The rod 19 of the piston 17 projects from the support 7 to operate the pressure block 16. In the illustrated embodiment, the block 16 is not rigid with the rod 19, but is traversed freely by it and is interposed between the section bar 5 and a plate 20 removably fixed to the end of the rod 19 by a screw 21. In this manner the block 16 is engaged and pressed by the plate 20 against the section bar or section bars 5 during the during the clamping of the combs 4, as shown in FIG. 1 or 5.

The chamber 18 is connected to a compressed air source indicated schematically by 22 via a hose 23 and a vale 24. The hose 23 is fixed directly to the piston 17 and communicates with the chamber 18 via a passageway 25 formed in the piston 17 and in that portion of the rod 19 adjacent to the piston 17. The valve 24 is preferably a three-way solenoid valve operated by example by two pushbuttons 26 and 27, one for making the connection between the chamber 18 and the source 22 (the machine being in stand-by) and the other for making the connection between the chamber 18 and discharge 28 (the machine being under halt conditions), by way of an actuator circuit indicated schematically by 29.

The seals on the piston 17 and on the rod 19 required for sealing the chamber 18 are not shown for simplicity.

It will be apparent that when the supports 7 have been fixed to the blocks 8 in the traditional manner, in order to remove the combs 4 for cleaning purposes it is necessary only to operate the valve 24 by the appropriate pushbutton to discharge the compressed air from the chamber 18. In this manner the presser blocks 16 release the section bars 5 to enable them to be withdrawn together with the respective combs 4 (FIG 7). To facilitate the positioning of the piston 17 and the relative block 16 in the release position of FIG. 7, a spring, not shown, may be provided.

The cleaned combs 4 are remounted by positioning the section bars 5 with the adjustment screws 11 resting against the surfaces 15 of the supports 7 and then operating that pushbutton for feeding compressed air into the chamber 18. No implement is therefore required either for removing or remounting the combs 4, these operations being extremely rapid and simple.

As compressed air is already available on combing machines, there is no need to use external sources. The pressure normally available is sufficient to ensure effective locking of the combs with the present device.

Advantageously several chambers 18 can be connected to the same valve 24 and the same compressed air source 22, and in particular the chambers 18 of all the supports 7, to achieve simultaneous locking or release of several combs 4 or of all the combs 4, as as indicated schematically by the tubes 23*a*, 23*b* shown by dashed lines in FIG. 5. The pneumatic system for simultaneously releasing and locking all the combs 4 of the machine can also be advantageously controlled by a microswitch operated respectively by the opening and closure of the cowling which covers the gripper units.

It is not essential to use one and the same fixing device of the invention for fixing the section bars 5 of two adjacent combs 4 at their respective ends. It would be possible to provide two spaced-apart devices to lock the section bar 5 of a single comb 4. The chamber 18 could be formed completely within the support 7 and be closed by a wall portion (removable for insertion of the piston 17) at the opposite end to the presser block 16. The block 16 could be directly fixed to the rod 19 of the piston 17.

I claim:

1. A device for fixing rectilinear combs in a combing machine comprising a plurality of combs, section bars for supporting said combs, support means for supporting said section bars, means for removably fixing said section bars to said support means, said fixing means being pneumatically operated presser element means for clamping at least one of said section bars to said support means, and means mounting said at least one section bar for slidingly removing motion generally normal to the direction of clamping movement of said clamping means.

2. The device as claimed in claim 1 wherein each of said pressure element means comprises a presser block and a pneumatically operated piston acting on said presser block, and said piston being movable between a first position in which said presser block clamps said at least one of said section bars against one of said support means and a second position in which said presser block releases said at least one of said section bars.

3. The device as claimed in claim 2 wherein said piston is movable within a chamber formed in a respective one of said support means and said piston having a piston rod projecting from said respective one of said support means in order to operate said presser block.

4. The device as claimed in claim 3 wherein said piston forms a closure wall of said chamber at an outside of said one of said support means.

5. The device as claimed in claim 2 wherein said presser block is substantially of a C-shape configuration and engages said at least of said section bars by means of end surfaces of said C-shape presser block.

6. The device as claimed in claim 3 further comprising a plate removably fixed to said piston rod for engaging said presser block.

7. The device as claimed in claim 3 wherein said piston and a portion of said piston rod adjacent to said piston comprise a passageway for introduction and discharge of compressed air into and from said chamber.

8. The device as claimed in claim 1, wherein adjustment screws are screwed and fixed into said section bars and engage a positioning surface on said support means.

9. The device as claimed in claim 1 wherein said presser element means are operated by respective pistons movable in respective chambers defined in said support means, and said chambers are connected simultaneously to a single compressed air source and to a discharge, respectively.

10. The device as claimed in claim 1, wherein said combs are adjacent each other, and section bars of adjacent combs are fixed by one of said presser elements.

11. The device as claimed in claim 1, comprising control means for actuating said fixing means, and means for supporting said control means for operation by a closure of a gripper unit cowling of a combing machine.

* * * * *